US005636927A

United States Patent [19]

Fox

[11] Patent Number: 5,636,927

[45] Date of Patent: Jun. 10, 1997

[54] METHOD AND APPARATUS FOR THERMALLY PRINTING ON LINERLESS MEDIA WITHOUT A PLATEN ROLLER/ SURFACE

[75] Inventor: Duane M. Fox, Snohomish, Wash.

[73] Assignee: Intermec Corporation, Everett, Wash.

[21] Appl. No.: 369,967

[22] Filed: Jan. 9, 1995

[51] Int. Cl.[6] ..... B41J 2/32

[52] U.S. Cl. ..... 400/619; 400/120.01; 347/218

[58] Field of Search ..... 400/617, 618, 400/619, 634, 636, 120, 120.01; 347/153, 154, 218, 219

[56] References Cited

U.S. PATENT DOCUMENTS

| | | | |
|---|---|---|---|
| 3,799,314 | 3/1974 | Smith | 400/618 |
| 4,232,325 | 11/1980 | Bradshaw et al. | 347/218 |
| 4,527,921 | 7/1985 | Koizumi et al. | 400/618 |
| 4,577,199 | 3/1986 | Saiki et al. | 400/618 |

FOREIGN PATENT DOCUMENTS

| | | | |
|---|---|---|---|
| 62-003977 | 1/1987 | Japan | 347/218 |
| 62-294564 | 12/1987 | Japan | 400/120 |
| 63-051169 | 3/1988 | Japan | 400/120 |
| 63-151467 | 6/1988 | Japan | 347/219 |
| 03-270948 | 12/1991 | Japan | 400/120.04 |

*Primary Examiner*—David A. Wiecking
*Attorney, Agent, or Firm*—L. David Rish

[57] ABSTRACT

A method of printing on a print face of a linerless media with the printing face of a printhead without a platen member opposite the printing face. The method comprises the steps of, guiding the print face of the media to a point close adjacent and slightly above the printing face; routing the print face across the printing face; pulling the media across the printing face from a point slightly above the printing face; and, creating a drag force on the media to hold the print face against the printing face during printing. A guide member guides the media to a point close adjacent the printing face. The drag can be created by putting a drag clutch on the supply roll, routing the media between drag rollers, or having a high friction surface on the guide member.

26 Claims, 4 Drawing Sheets

METHOD AND APPARATUS FOR THERMALLY PRINTING ON LINERLESS MEDIA WITHOUT A PLATEN ROLLER/ SURFACE

BACKGROUND OF THE INVENTION

1. Technical Field

This invention relates to printers for printing on media such as labels and, more particularly, to apparatus for holding a print face of a linerless media against the printing face of a printhead during printing without a platen member opposite the printing face, comprising, means for creating a reversed bend of the linerless media across the printing face and means for holding the reversed bend during printing by applying opposing forces to the linerless media across the printing face.

2. Background Art

There are numerous devices in the prior art which move and process strip media. As depicted in FIG. 1, it is a simple matter to dispose the media 10 between a driven roller 12 and a pinch roller 14 to move the media 10 as indicated by the arrow. Where the media 10 has no adhesive backing or where any adhesive is covered with a removable liner, the prior art approach of FIG. 1 can be used successfully.

In the field of tag and labels with particularity, there is a strong movement and demand for so-called "linerless" media. That is, the backing of the media is covered with an adhesive which is not covered with a removable liner during printing and process and up to the time of application to a surface. If media 10' having active adhesive 16 on its back surface is used in processing equipment configured as in FIG. 1, the result is as shown in FIG. 2. If the adhesive 16 is aggressive and has above minimal surface tenacity, it will strongly adhere to the roller 12 eventually causing the machinery to bind and come to a stop.

One approach in the industry has been to employ an adhesive which is only activated after processing. This can be done by heat, water, or some other means. This is fine if the application can employ the kind of adhesives which are post-processing activatable. Unfortunately, the pressure sensitive adhesives employed for tags and labels is not available in that form. If tags and labels are going to stay attached to packages and the like during the rigors of transit, a highly aggressive adhesive must be used. Such adhesives are only available in a form which remains active from application to the media.

It is very convenient to print on tags and labels using a thermal print head. Since printing is effected by heating each pixel position on the print surface that is to be a "dot" to the point that the thermal coating on the print surface changes color, it is important that there be a close thermal bond between the printhead elements providing the heat at each pixel position. To prevent bleeding from one pixel position to the other and allow rapid printing speeds, the heating and subsequent cooling of each element must be quick and very localized. Thus, in the prior art, it has been the standard approach to support the media to be printed upon within the print zone and opposite the printhead with a platen roller or platen surface. The printhead can then slide over the media in direct contact with the print surface. As can be appreciated from the drawing of FIG. 2, if one uses the prior art approach with linerless media, the platen roller or platen surface will quickly become fouled with adhesive and render the printer inoperable.

Wherefore, it is the object of this invention to provide methods and associated apparatus for printing on active adhesive linerless media without the use of a platen roller or platen surface with associated problems of binding, sticking, and the like.

Other objects and benefits of this invention will become apparent from the description which follows hereinafter when read in conjunction with the drawing figures which accompany it.

SUMMARY OF THE DISCLOSURE

The foregoing objects have been attained by the apparatus of the present invention for holding a print face of a media against the printing face of a printhead during printing without a platen member opposite the printing face comprising, means for creating a reversed bend of the media across the printing face and means for holding the reversed bend during printing by applying opposing forces to the media across the printing face.

The preferred embodiment further comprises, a supply roll providing the media located before the printing face; means for applying a drag to the media to create a drag force in one direction; and, means for pulling the media from a point after the printing face to create a pulling force opposing the drag force.

In one implementation, the means for applying a drag to the media comprises, a friction clutch on the supply roll; and, the means for pulling the media from a point after the printing face comprises a driven roller in combination with a pinch roller.

Preferably, there are also guide means for guiding the media to a support and guide point located close adjacent the printing face.

In that case, another embodiment comprises, the means for applying a drag to the media comprises a high friction surface on the guide means over which the media is pulled; and, the means for pulling the media from a point after the printing face comprises a driven roller in combination with a pinch roller.

In yet a third embodiment, the means for applying a drag to the media comprises a pair of drag rollers through which the media is pulled; and, the means for pulling the media from a point after the printing face comprises a driven roller in combination with a pinch roller.

DETAILED DESCRIPTION OF THE PREFERRED EMBODIMENT

Figure 1:
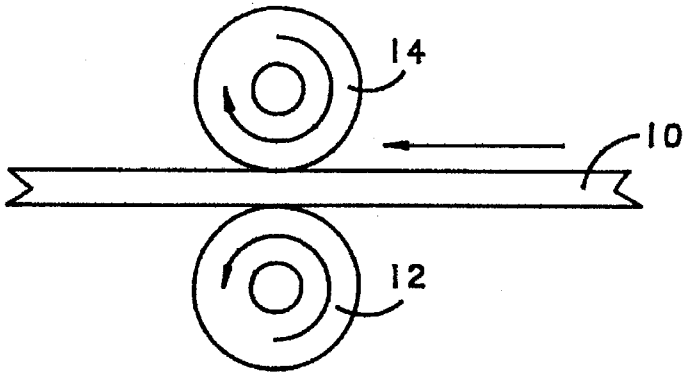
PRIOR ART FIG. 1
FIG. 1 is a simplified drawing of a prior art approach to moving and supporting lined or adhesiveless media.
Figure 2:
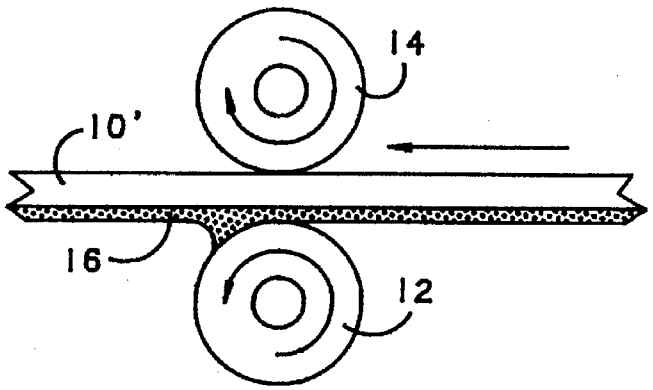
PRIOR ART FIG. 2
FIG. 2 is a simplified drawing depicting the results if linerless media is moved and/or supported by the prior art approach of FIG. 1.
Figure 3:
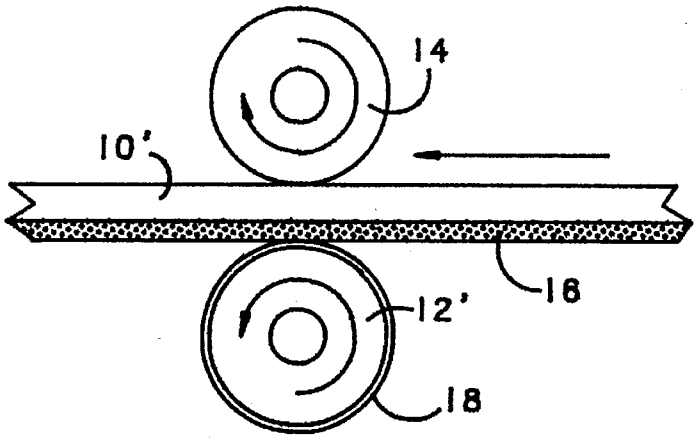
FIG. 3 is a simplified drawing depicting a non-sticking roller of an alternative approach to this invention in its most basic form moving and supporting linerless media.
Figure 4:
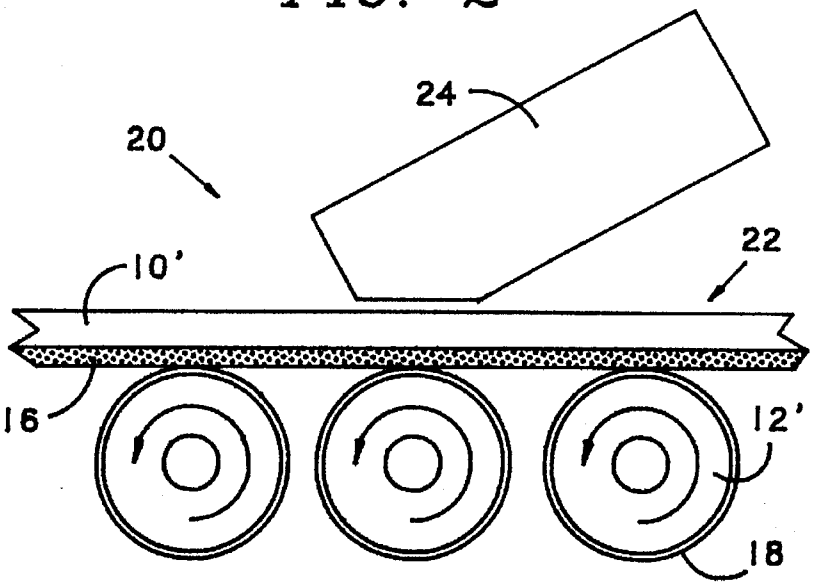
FIG. 4 shows how the roller of FIG. 3 can be used as a platen roller or support.

An alternate approach to the subject invention to solving the problem of moving and supporting linerless media is shown which can be incorporated into apparatus according to the present invention. The basic premise of that alternate approach is to make all supporting and rotational parts which contact the adhesive of linerless media act in the manner of a liner. That is, even though they contact an aggressive adhesive, they do not adhere more than minimally and release easily without any transfer or sticking of the adhesive. One way of accomplishing this is shown in FIG. 3. The roller 12' in contact with the adhesive 16 is covered with a release coating 18. If the roller 12' (or other device of like use) is one requiring rigidity, the release coating 18 is a hard coating. Soft rollers, and the like, such as platen rollers needed as a backing surface, have a soft release coating. If one were to implement a print station 20 for linerless media 22 according to that alternate approach, it could appear as in FIG. 4 with a roller 12' acting a platen roller for the printhead 24. As will be appreciated from the description of the present invention which follows hereinafter, while the present invention does not actively support the linerless media 22 opposite the printhead 24, the balance of movement of the linerless media 22 through the printer can be, and preferably is, accomplished according to the above-described alternative approach to the invention.

Figure 5:
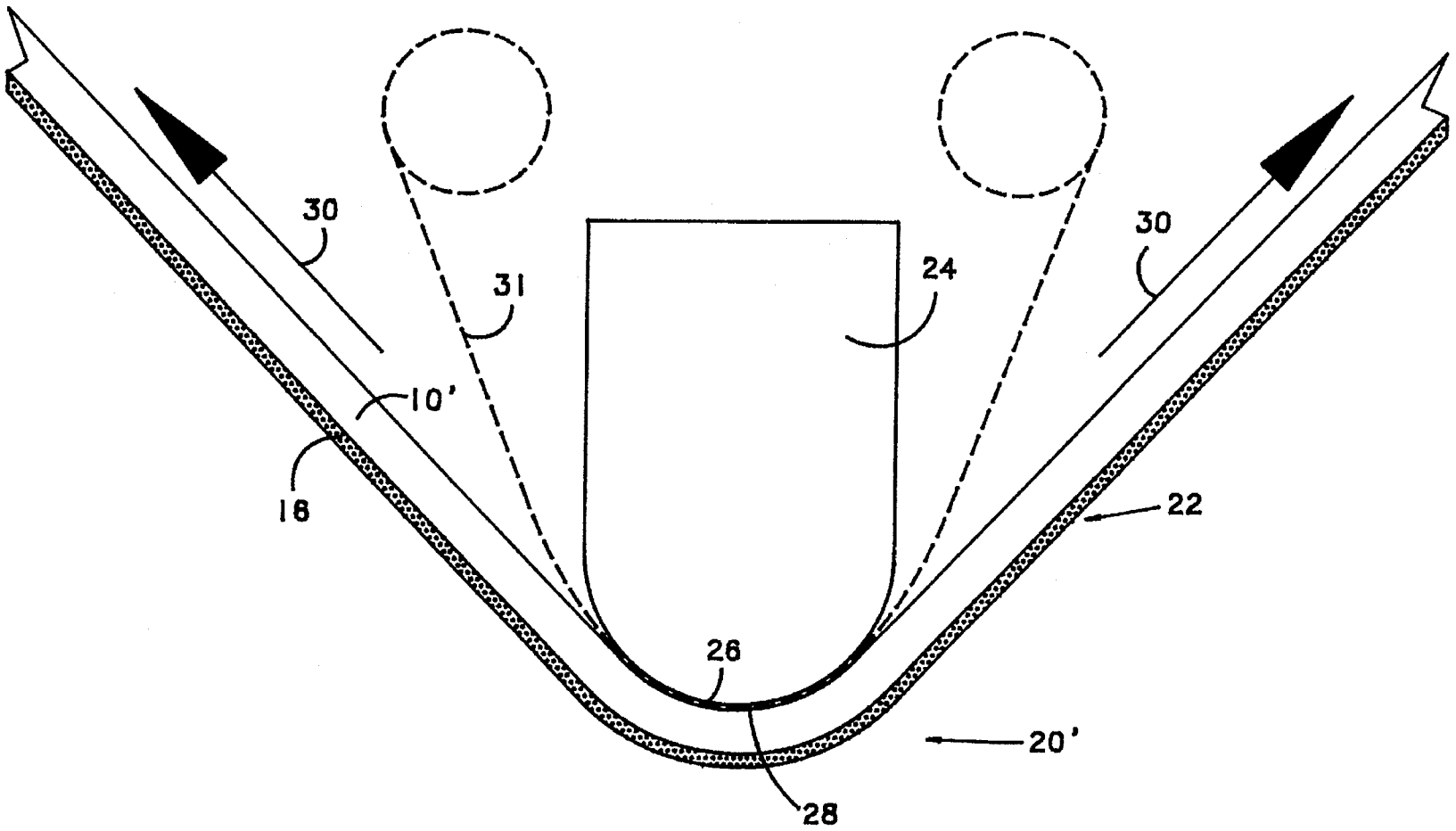
FIG. 5 shows a printing station according to the present invention.

The basic approach of the present invention for implementing a print station 20' is depicted in FIG. 5. The print face 26 of the linerless media 22 is kept in tension across the printing face 28 of the printhead 24 as symbolized by the arrows 30. In that way, there is no need for anything by way of a platen roller or platen surface to contact the adhesive 16 of the linerless media 22 opposite the printhead 24. As those of ordinary skill in the art will undoubtedly recognize and appreciate, while the primary thrust of this specification and the drawings which accompany it is directed to a thermal printhead printing on a heat-activate thermal paper as the print face of the media, the present invention and its platenless printing technique would also work for thermal transfer printing. In that case, the thermal transfer ink ribbon moving in combination with the linerless media 22 would be positioned between the print face 26 and the printing face 28 as indicated by the ghosted line 31 in FIG. 5. Several ways in which the present invention can be implemented in an actual linerless media thermal printer will now be described in detail.

Figure 6:
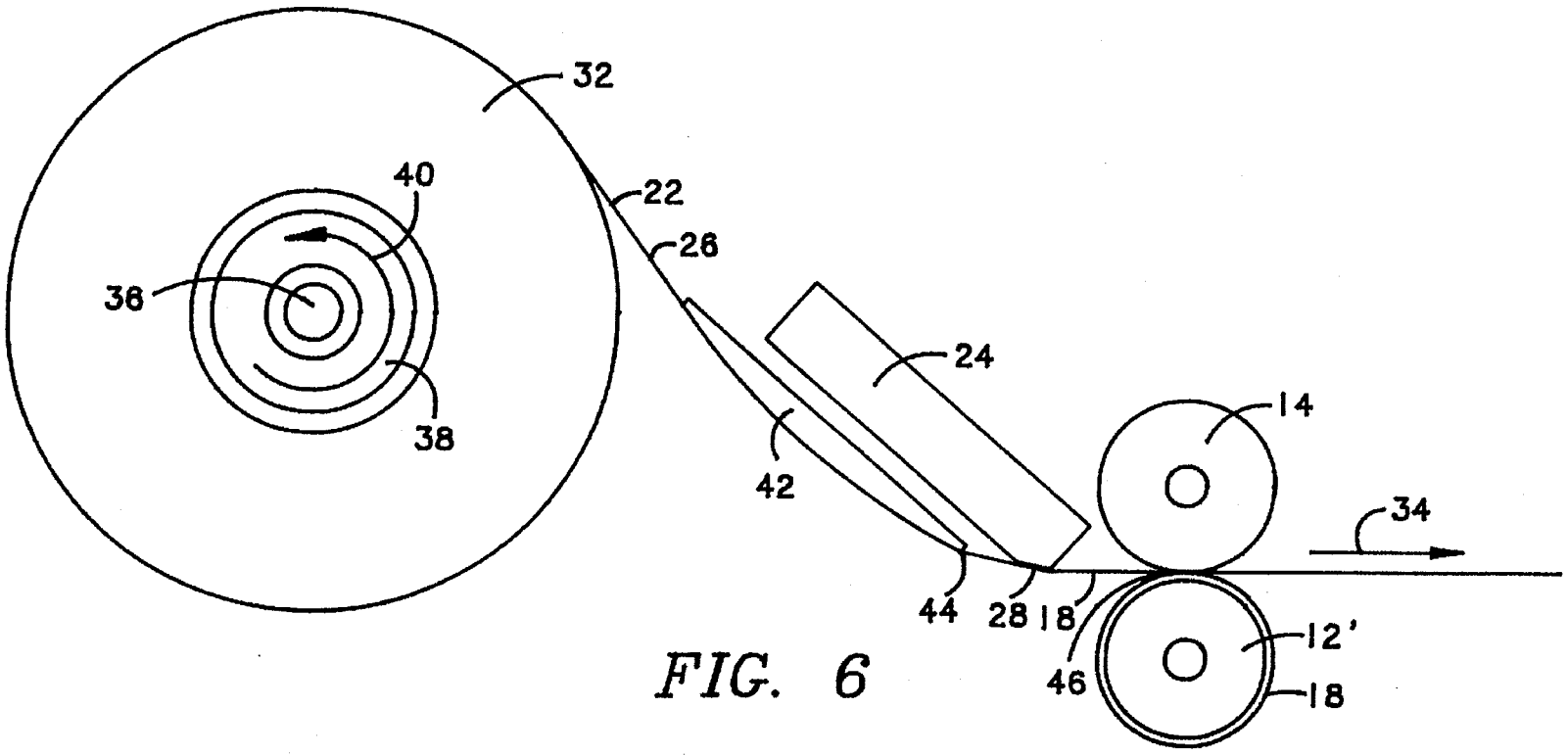
FIG. 6 shows a modification of the printing station.

In the embodiment of FIG. 6, the linerless media 22 is pulled from a supply roll 32 by the driven roller 12' (according to the above-referenced co-pending application since it is in contact with the adhesive 16) and the pinch roller 14. This creates a pulling force as symbolized by the arrow 34 in one direction. The supply roll 32 is mounted on a shaft 36 with a friction clutch 38 which supplies a drag force as symbolized by the arrow 40. The friction clutch can be of any type well known in the art for such drag-producing purposes and, per se, forms no part of the novelty of the present invention. Thus, as will be recognized, the two opposing forces indicated by the arrows 34 and 40 correspond to the opposing forces indicated by the arrows 30 in FIG. 5. Having produced the opposing forces utilized by the present invention in place of a platen, all that is required is a way to route the linerless media 22 so as to have those forces 34, 40 hold the print face 26 against the printing face 28 during printing. That aspect of the present invention will now be described.

Figure 8:
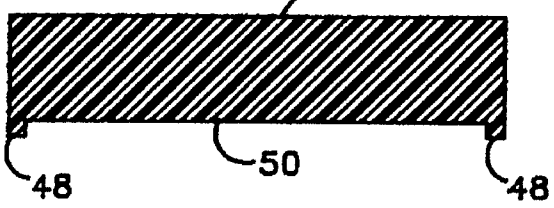
FIG. 8 shows a cross section along lines VIII—VIII in FIG. 7.
Figure 7:
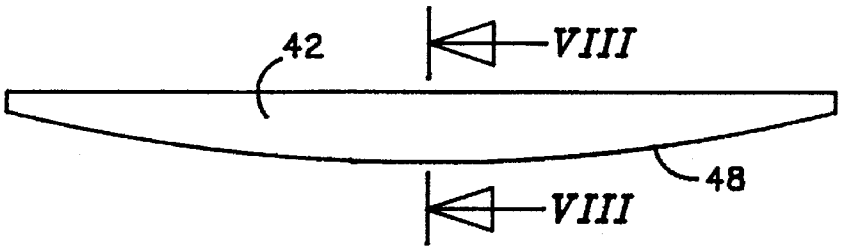
FIG. 7 shows greater detail of a guide member.

The printing face 28 of the printhead 24 should be pressed against the print face 26 of the linerless media 22 sufficiently to cause maximum heat transfer; but, it should not be held so tightly as to cause undue friction or be bent excessively so as to cause wrinkling or other detrimental effects. For this reason, the preferred embodiment of the present invention employs the elongated guide member 42 shown in greater detail in FIGS. 7 and 8. The guide member 42 is long and slender (as opposed to a fat roller) so that it can be slipped in adjacent the printhead 24 in the manner shown in FIG. 6 to provide a support and guide point 44 close adjacent the printing face 28 on the supply roll side of the printhead 24. The guide member 42 is only necessary to feed the linerless media 22 into the printhead 24 at the proper angle and alignment for printing with respect to the driven roller and pinch roller pair's, 12,14, entry point 46. After printing, the pair 12,14 can remove the linerless media 22 for subsequently routing as desired. The only requirement is that the printing face 28 be slightly in front of a line drawn between the support and guide point 44 and the entry point 46 so as to create the slight bend across the printing face 28 (shown exaggerated in FIG. 5) which holds the print face 26 against the printing face 28 during printing.

The guide member 42 can be of metal or plastic (as shown) and preferably has side ears 48 adjacent the guide surface 50 for maintaining the linerless media 22 centered on the guide member 42. In this embodiment, the guide surface 50 is of a smooth, low-friction material since the drag force 40 is created by the friction clutch 38.

Figure 9:
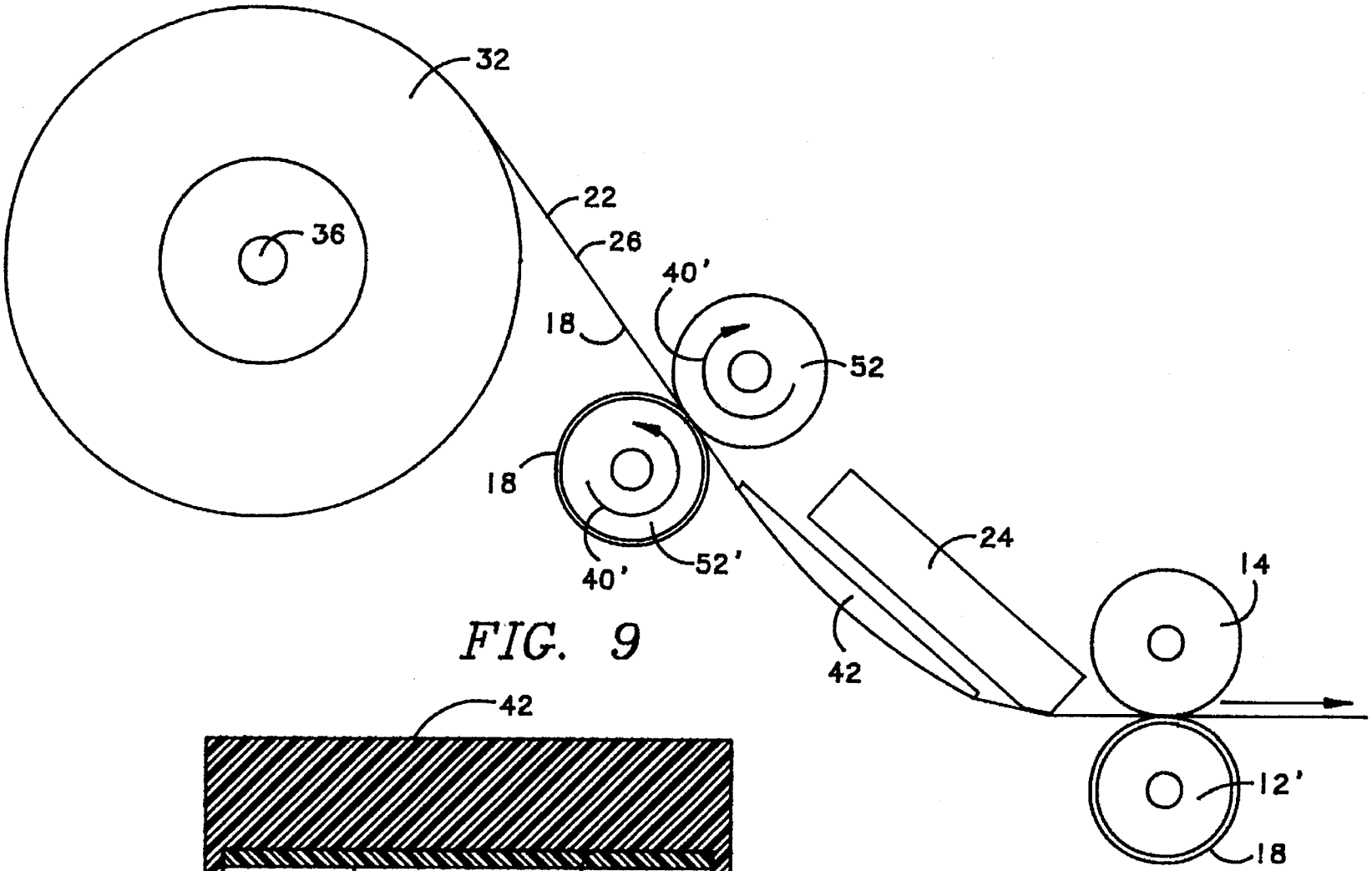
FIGS. 9 & 10 show other embodiments of the present invention.
Figure 10:
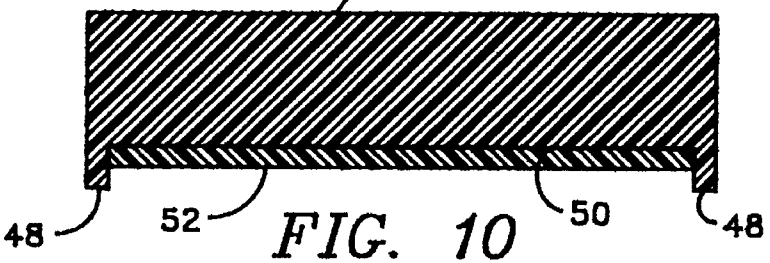

Other embodiments or ways of implementing the present invention are shown in FIGS. 9 and 10. Others within the scope and spirit of the invention will undoubtedly be apparent to those of ordinary skill in the art and are intended to be included within the scope of coverage afforded by the claims appended hereto.

In lieu of the friction clutch 38, a pair of drag rollers 52 and 52' can be provided to roll along and impart a drag force as indicated by the arrows 40' on the linerless media 22. The roller 52' since it rolls on the adhesive 16 is, of course, one of the rollers according to the above-referenced, co-pending application. A friction clutch or other friction-producing approach well known to those skilled in the art can be used to cause the rollers 52,52' to produce the desired drag force 40'.

In lieu of or in addition to the drag rollers 52, 52', the guide member 42 can have a piece of high friction material 52 lining the guide surface 50. While a low friction, wear-tolerant plastic such as polytetrafluorethylene (i.e. Teflon) can be used to advantage for the guide member 42 in embodiments requiring low friction, high friction can be obtained, for example, by using rubber or a plastic with rubber-like qualities as the high friction material 52.

Thus, it can be seen from the foregoing description and the drawing figures that accompany it that the object of the present invention has been accomplished by creating a reversed bend of the linerless media 22 across the printing face 28 and holding that reversed bend during printing by the application of opposing forces in the linerless media 22 across the printing face 28.

Wherefore, having thus described the present invention, what is claimed is:

1. A print station for printing on linerless media without a platen member comprising:

a) a stationary printhead having a fixed printing face;

b) a supply roll providing the linerless media located before said printing face;

c) the printing face of said printhead creating a reversed bend of the linerless media with a print face thereof across the printing face;

d) a friction clutch applying a drag to the linerless media to create a drag force in one direction; and, e) a driven roller in combination with a pinch roller pulling the linerless media from a point after said printing face to create a pulling force opposing said drag force whereby to hold said print face of the linerless media against said printing face of said printhead during printing.

2. The print station of claim 1 and additionally comprising:

a guide member guiding the linerless media to a support and guide point located close adjacent said printing face.

3. The print station of claim 2 wherein:

a) a high friction surface is located on said guide means over which the linerless media is pulled; and, b) a driven roller acts in combination with a pinch roller to pull the linerless media across said printhead.

4. The print station of claim 1 wherein:

a) a pair of drag rollers act to pull the linerless media; and, b) a driven roller acts in combination with a pinch roller to pull the linerless media across said printhead.

5. A method of holding a print face of a linerless media against the fixed printing face of a stationary printhead during printing without a platen member opposite the printing face comprising the steps of:

a) creating a reversed bend of the linerless media across the printing face; and, b) holding the reversed bend during printing by the application of opposing forces to the linerless media across the printing face.

6. The method of claim 5 wherein the linerless media is fed from a supply roll located before the printing face and additionally including the steps of:

a) applying a drag to the supply roll to create a drag force in one direction; and, b) pulling the linerless media from a point after the printing face to create a pulling force opposing the drag force.

7. The method of claim 5 and additionally including the step of:

guiding the linerless media to a support and guide point located close adjacent the printing face.

8. The method of claim 7 wherein the linerless media is fed from a supply roll located before the printing face and additionally including the steps of:

a) guiding the linerless media before the printing face across a high friction surface to create a drag force in one direction; and, b) pulling the linerless media from a point after the printing face to create a pulling force opposing the drag force.

9. The method of claim 5 wherein the linerless media is fed from a supply roll located before the printing face and additionally including the steps of:

a) routing the linerless media before the printing face through a pair of drag rollers to create a drag force in one direction; and, b) pulling the linerless media from a point after the printing face to create a pulling force opposing the drag force.

10. Apparatus for holding a print face of a media against the fixed printing face of a stationary printhead during printing without a platen member opposite the printing face comprising:

a) stationary means for creating a reversed bend of the media across the printing face; and, b) means for holding the reversed bend during printing by applying opposing forces to the media across the printing face.

11. The apparatus of claim 10 and additionally comprising:

a) a supply roll providing the media located before the printing face;

b) means for applying a drag to the media to create a drag force in one direction; and, c) means for pulling the media from a point after the printing face to create a pulling force opposing said drag force.

12. The apparatus of claim 11 wherein:

a) said means for applying a drag to the media comprises a friction clutch on said supply roll; and, b) said means for pulling the media from a point after the printing face comprises a driven roller in combination with a pinch roller.

13. The apparatus of claim 11 and additionally comprising:

guide means for guiding the media to a support and guide point located close adjacent the printing face.

14. The apparatus of claim 13 wherein:

a) said means for applying a drag to the media comprises a high friction surface on said guide means over which the media is pulled; and, b) said means for pulling the media from a point after the printing face comprises a driven roller in combination with a pinch roller.

15. The apparatus of claim 11 wherein:

a) said means for applying a drag to the media comprises a pair of drag rollers through which the media is pulled; and, b) said means for pulling the media from a point after the printing face comprises a driven roller in combination with a pinch roller.

16. A print station for printing on linerless media without a platen member comprising:

a) a stationary printhead having a fixed printing face;

b) a supply roll providing the linerless media located before said printing face;

c) means for creating a reversed bend of the linerless media with a print face thereof across the printing face;

d) means for applying a drag to the linerless media to create a drag force in one direction; and, e) means for pulling the linerless media from a point after said printing face to create a pulling force opposing said drag force whereby to hold said print face of the linerless media against said printing face of said printhead during printing.

17. The print station of claim 16 wherein:

a) said means for applying a drag to the linerless media comprises a friction clutch on said supply roll; and, b) said means for pulling the linerless media from a point after said printing face comprises a driven roller in combination with a pinch roller.

18. The print station of claim 16 and additionally comprising:

guide means for guiding the linerless media to a support and guide point located close adjacent said printing face.

19. The print station of claim 18 wherein:

a) said means for applying a drag to the linerless media comprises a high friction surface on said guide means over which the linerless media is pulled; and, b) said means for pulling the linerless media from a point after said printing face comprises a driven roller in combination with a pinch roller.

20. The print station of claim 16 wherein:

a) said means for applying a drag to the linerless media comprises a pair of drag rollers through which the linerless media is pulled; and, b) said means for pulling the linerless media from a point after said printing face comprises a driven roller in combination with a pinch roller.

21. A method of printing on a print face of a linerless media with the fixed printing face of a stationary printhead without a platen member opposite the printing face comprising the steps of:

a) guiding the print face of the linerless media to a point close adjacent and slightly above the printing face;

b) routing the print face across the printing face;

c) pulling the linerless media across the printing face from a point slightly above the printing face; and, d) creating a drag force on the linerless media to hold the print face against the printing face during printing.

22. Apparatus for holding a print face of a media against the fixed printing face of a stationary printhead during printing without a platen member opposite the printing face comprising:

a) said printhead creating a reversed bend of the media across the printing face; and, b) a supply roll and a driven roll holding the reversed bend during printing by applying opposing forces to the media across the printing face.

23. The apparatus of claim 22 and additionally comprising:

a) said supply roll providing the media located before the printing face;

b) a friction clutch applying a drag to the media to create a drag force in one direction; and, c) a a driven roller in combination with a pinch roller pulling the media from a point after the printing face to create a pulling force opposing said drag force.

24. The apparatus of claim 23 and additionally comprising:

a guide member guiding the media to a support and guide point located close adjacent the printing face.

25. The apparatus of claim 24 wherein:

a) a high friction material comprises a high friction surface on said guide member over which the media is pulled; and, b) a pulling force is created by a driven roller acting in combination with a pinch roller.

26. The apparatus of claim 23 wherein:

a) a drag is applied to the media by a pair of drag rollers through which the media is pulled; and, b) a pulling force is created by a driven roller acting in combination with a pinch roller.

* * * * *